United States Patent [19]

Wild

[11] 3,982,475

[45] Sept. 28, 1976

[54] DOUBLE-WALL FACADE ELEMENT FOR BUILDINGS HAVING AN OVERPRESSURE VENTILATING OR AIR CONDITIONING INSTALLATION

[75] Inventor: Ernst Wild, Stafa, Switzerland

[73] Assignee: Electrowatt AG, Zurich, Switzerland

[22] Filed: June 2, 1975

[21] Appl. No.: 583,194

[30] Foreign Application Priority Data

June 12, 1974 Switzerland ..... 8021/74

[52] U.S. Cl. ..... 98/31; 98/33 R

[51] Int. Cl.[2] ..... F24F 7/00; F24F 13/00

[58] Field of Search ..... 98/31, 33 R

[56] References Cited

UNITED STATES PATENTS

| | | | |
|---|---|---|---|
| 2,272,829 | 2/1942 | Bohnsack | 98/31 |
| 2,281,002 | 4/1942 | Eck | 98/33 R |
| 2,961,940 | 11/1960 | Kump | 98/31 |
| 2,988,980 | 6/1961 | Tschudin | 98/31 |
| 3,049,067 | 8/1962 | Claude | 98/33 R |
| 3,905,548 | 9/1975 | Brodie | 98/31 |

*Primary Examiner*—Lloyd L. King
*Attorney, Agent, or Firm*—Werner W. Kleeman

[57] ABSTRACT

A double-wall facade element for buildings having an overpressure ventilating or air conditioning installation wherein at the region of a horizontal edge of the element there is provided at its inner wall a throughpassage opening for exhaust air and at the region of the other horizontal edge there is provided at its outer wall a blow-off or exhaust opening for the exhaust air, both openings being in flow communication with one another via an intermediate space or compartment between the inner wall and the outer wall. The flow cross-section of the throughpassage opening is greater than the flow cross-section of the blow-off or exhaust opening, but smaller than the flow cross-section of the intermediate compartment. Further, at the region of the exhaust opening there is arranged a check valve responsive to increasing external pressure in order to throttle its flow cross-section, so that in the intermediate compartment there can be adjusted a pressure gradient between the throughpassage opening and the blowoff or exhaust opening which is smaller than the difference between the water vapor partial pressure in the interior of the building and the water vapor partial pressure in the outside area in the presence of external temperatures which are lower in relation to the internal temperature.

18 Claims, 4 Drawing Figures

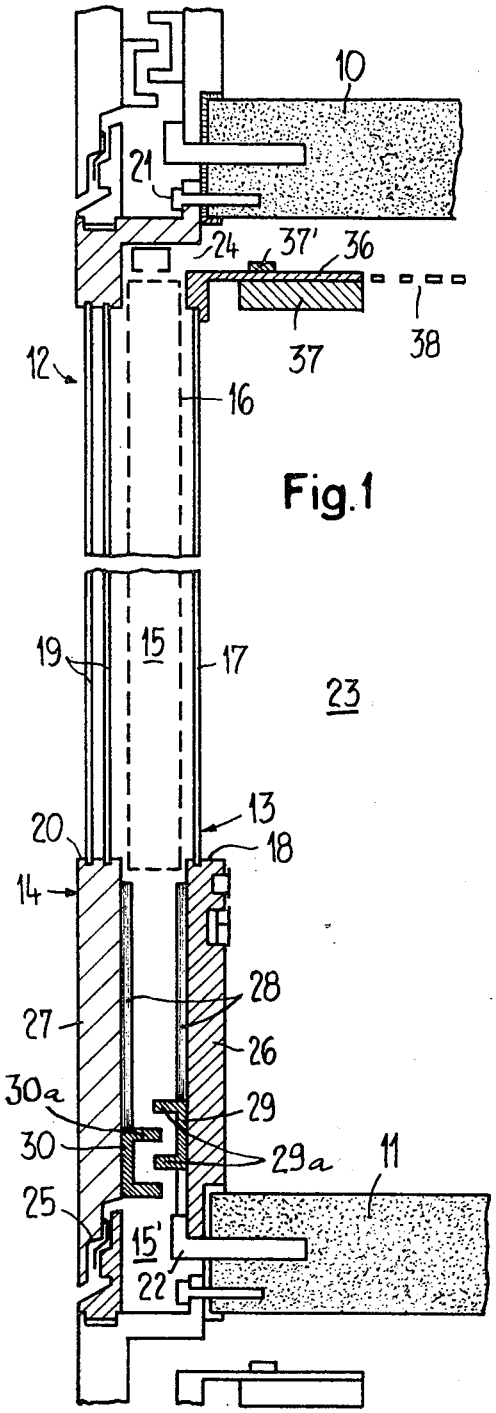
Fig.1
Fig.2
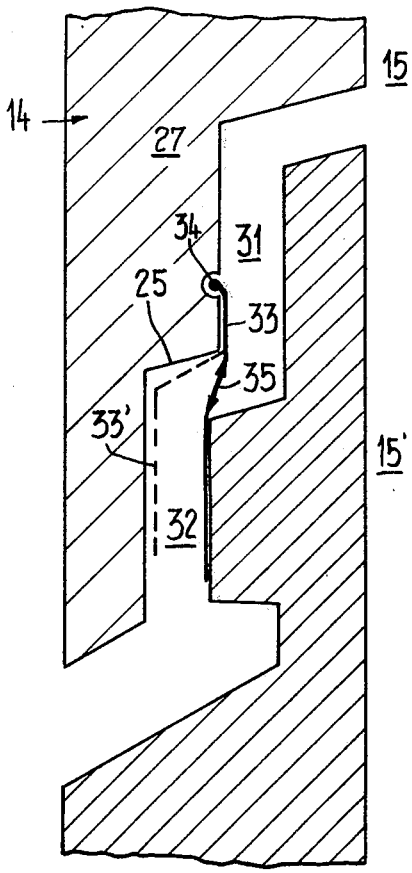

DOUBLE-WALL FACADE ELEMENT FOR BUILDINGS HAVING AN OVERPRESSURE VENTILATING OR AIR CONDITIONING INSTALLATION

BACKGROUND OF THE INVENTION

The present invention relates to a new and improved construction of a double-wall facade or front element for buildings operating with an overpressure ventilating or air conditioning installation, wherein at the region of the one horizontal edge of the element there is provided at its inner wall a throughpassage opening for exhaust air and at the region of the other horizontal edge there is provided at its outer wall a blow-off or exhaust opening for the exhaust air, both of the aforementioned openings being in flow communication with one another through the agency of an intermediate space or compartment between the inner wall and the outer wall.

It has been found that the energy consumption for the ventilation or climatizing or conditioning of buildings or structures equipped with such facade elements is extremely low. In practice, with such facade elements the intermediate compartment or space between the inner wall and the outer wall is continuously wiped by the exhaust air which is to be ejected and after the escape of the exhaust air through the blow-off or exhaust opening such exhaust air continuously blows over the facade element, so that the outside climatic conditions and the inside climatic conditions are always separated by two extremely effective convection barriers.

While this very effective insulation (in the case of facade elements provided with window openings covered by glass panes there is attained a coefficient of heat transfer $k$, related to the entire facade element, of only 0.3 to kcal/m²h°C) works extremely well particu larly in the case of external or ambient temperatures at the region of the freezing point or therebelow, in the case of pronounced temperature gradients there arise phenomena which are capable of impairing the properties of such facade elements which are particularly favorable with respect to the heat balance.These phenomena are dependent upon the condensation of the moisture of the exhaust air as soon as such, upon coming into direct contact with the outside air, is very rapidly cooled to the temperature thereof. It is to be conceived, for instance that with an inside of temperature of 250°C and a relative humidity of 50 percent the moisture content of the air amounts to approximately 10 $g$/kg dry air, whereas with an air temperature of 0°C the water content corresponding to saturation (relative humidity = 100 percent) is in the order of approximately 4 $g$/kg dry air. Hence, upon the ejection of the exhaust air considerable quantities of water condense, which when the temperatures are below the freezing point result in icing of complete portions of the facade and along therewith the impairment of the properties of the facade elements.

SUMMARY OF THE INVENTION

Hence, it is a primary object of the present invention to provide an improved facade element which is not associated with the aforementioned drawbacks and limitations of the prior art constructions.

Another and more specific object of the present invention aims at the provision of a new and improved construction of facade element of the previously mentioned type wherein such condensation phenomenon quite generally no longer occurs as a practical matter in the case of external temperatures which are lower in contrast to the inside temperature.

Now in order to implement these and still further objects of the invention, which will become more readily apparent as the description proceeds, the facade element of the previously mentioned type and as contemplated by the invention is manifested by the features that the flow cross-section of the throughpassage opening is greater than the flow cross-section of the blow-off or exhaust opening, however smaller than the flow cross-section of the intermediate space or compartment. Further, in or at the region of the exhaust opening there is arranged a check or nonreturn valve which is responsive to increasing external pressures, in order to throttle the flow cross-section of such exhaust opening so that there can be adjusted a pressure gradient in the intermediate compartment between the throughpassage opening and the exhaust opening, and which pressure gradient is smaller than the difference between the partial pressure of the water vapor in the interior of the building and the partial pressure of the water vapor in the external space with an external temperature which is lower in contrast to the internal or inside temperature.

It has been surprisingly found that with such coordination of the dimensions of the flow cross-section of the throughpassage opening and the exhaust opening as well as the intermediate compartment with regard to one another there does not arise the feared condensation at the outer surface of the facade element. At the present time there is the tendency to explain this surprising effect in terms of the fact that the pressure difference which is effective for the air flow in the intermediate compartment, and which pressure difference is smaller than the difference of the partial pressure of the water vapor within the building and at the outside area, results in such a low flow velocity that the moisture in the exhaust air leads its actual flow movement, migrates away and along therewith brings about a drying of the exhaust air which increases as a function of the path through which the exhaust air moves in the intermediate compartment. Hence, the exhaust air at the moment of its departure through the blow-off or exhaust opening already possesses such a low moisture content that condensation is no longer possible.

This phenomenon is further favored owing to the relationship of the diffusion velocity of water vapor in air and vice versa, which as is known is inversely proportional to the square root of the molecular weight of both gases. In the case of air the average molecular weight amounts to 28.98 and for water vapor (gaseous water) 18. Consequently, the diffusion velocity of water vapor in air is approximately 1.3 times as large as tht of air in water vapor.

The check or nonreturn valve advantageously can be a band hingedly connected at its upper end, the band being formed by a flexible material and through which piercingly extend openings. In this way the throughpassage cross-section of the blowoff or exhaust opening is not reduced to null even when the check or nonreturn valve is completely closed.

On the other hand, the check valve can have subsequently arranged a further throughflow or throughpassage opening which, in the case of negative pressures arising in the external space, is at least partially covered by the check valve. Hence, the pressure gradient adjusted in the intermediate compartment or space is not appreciably disturbed even if there is present a suction of vacuum which temporarily acts at the facade element of the building, so that the flow velocity only inconsequentially increases in the intermediate compartment.

The check valve is advantageously inwardly or rearwardly arranged within the outer wall. This results in a smooth outer surface of the facade element which is desirable and strived for in certain circumstances.

BRIEF DESCRIPTION OF THE DRAWINGS

The invention will be better understood and objects other than those set forth above, will become apparent when consideration is given to the following detailed description thereof. Such description makes reference to the annexed drawings wherein:

FIG. 1 is a cross-sectional view through a portion of the facade of a building or the like formed of pre-fabricated facade elements designed according to the present invention;

FIG. 2 is an enlarged detail of the arrangement shown in FIG. 1;

DETAILED DESCRIPTION OF THE INVENTION

Figure 3:
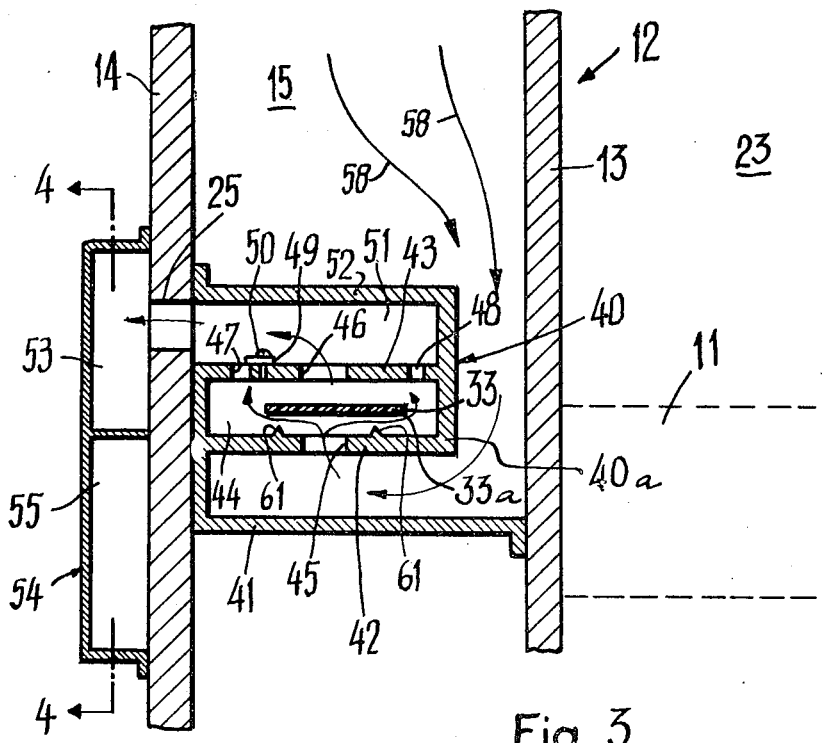
FIG. 3 is a cross-sectional view through a variant embodiment of facade element at the region of the blow-off or exhaust opening.

Describing now the drawings, in the exemplary embodiment illustrated by way of example in FIG. 1 there will be recognized two floor plates or floors 10, 11 at which merges at the facade side of the structure a facade element generally designated by reference character 12. This facade element 12 is designed as a double-wall structure and possesses an inner wall 13 as well as an outer wall 14 between which there remains free an intermediate space or compartment 15. This intermediate compartment or space 15 can serve to house, for instance, a lamellae shutter or blind 16, such as a Venetian blind, shown schematically with broken lines. The inner wall 13 at the facade element 12 possesses a window opening 18 which is covered by a glass pane 17 and the outer wall 14 possesses a window opening 20 covered with a double-glass pane 19. The facade element 12 is connected at its upper end by means of bolts 21 or equivalent fastening devices with the upper floor plate or floor 10 and at its lower end such facade element 12 bears upon a hook-like support profile member 22 anchored in the floor plate or floor 11. From the region of the space or area 23 located between the floors 10, 11 there extends a substantially slot-shaped throughflow or throughpassage opening 24 into the intermediate compartment or space 15 between the inner wall 13 and the outer wall 14, this throughpassage opening 24 being formed at the region of the underside of the floor 10 in the inner wall 13 of the facade element 12. Moreover, along the oppositely situated horizontal edge of the facade element 12 there is provided at its outer wall 14 a blow-off or exhaust opening 25 leading from the intermediate compartment or space 15 into the surroundings. It is to be observed that both the throughpassage opening 24 as well as the exhaust opening 25 extend practically over the entire length of the facade element 12, i.e. in the dimension which is disposed perpendiuclar to the plane of the drawing.

From what has been stated above it will be recognized that in the event of an overpressure prevailing in the space or area 23 there is always present a flow from the throughpassage opening 24 through the intermediate compartment 15 to the exhaust opening 25. In any event both the throughpassage opening 24 as well as the exhaust opening 25 constitutes a throttle location which produces the result that the pressure differential effective in the intermediate compartment 15 is considerably smaller than the pressure gradient between the space 23 and the external pressure prevailing about the building. The intermediate compartment 15 is lined at the region of the ledge 26 of the inner wall 13 which merges with the floor 11 and the ledge 27 of the outer wall 14 with plates or plate members 28 formed of a suitable sound-absorbing material. Additionally, at the lower end of the intermediate compartment 15 there are arranged at the ledges 26 and 27 two substantially U-shaped profile or structural members 29, 30 which are likewise formed of a suitable sound-absorbing material, these profile members being arranged in such a manner that the leg **30*a* of the one profile member 30 extends between the legs 29*a* of the other profile member 29, as best seen by referring to FIG. 1. Consequently, there is formed in front of the exhaust opening 25 a further throttle location, so that the pressure gradient in the intermediate compartment or space 15 is still further reduced. Additionally, both of the profile or structural members 29 and 30 provide a very effective insulation against acoustical vibrations which can enter via the exhaust opening 25 and could excite the glass panes 17** into sympathetic vibrations.

As particularly well recognized by inspecting FIG. 2 the exhaust or blow-off opening 25 extends from the intermediate compartment 15 downwardly in a staircase or step-like configuration and possesses two vertically extending portions or sections 31 and 32 which are arranged offset with respect to one another. Between both of these sections or portions 31 and 32 there is provided a check or nonreturn valve 33 or equivalent structure which is hingedly connected at the hinge location or pivot axis 34, the check valve 33 being formed of a flexible, elastomeric-like material which extends over the entire length of the exhaust opening 25. In the check valve 33, as indicated by reference character 35, there are provided openings which prevent that the entire flow cross-section of the exhaust opening 25 during "closing" of the check valve 33 is closed. Quite to the contrary, due to the "closing" of the check valve 33 the flow cross-section of the exhaust opening 25, which is essentially determined by the flow cross-section of the sections or portions 31 and 32, is increasingly reduced to the dimension of the openings 35. As a result there is realized at least at the region of the openings 35 a considerable increase of the throughflow velocity, so that the flow out of the intermediate compartment or space 15, notwithstanding the smaller pressure gradient which prevails at that location, is also then maintained if owing to the presence of a pressure peak or surge the check valve 33 is forced into the position depicted in FIG. 2. In the event that there is not present any pressure peak or surge which is effective from the outside, then the check valve 33 assumes approximately the position shown in broken lines in FIG. 2, designated as the "floating" position represented by reference character 33'.

Another important feature of this exemplary embodiment of the facade element of this development resides in the fact that between the inner end of the exhaust opening 25 and the U-shaped profile members 29 and 30 there is once again present a widening of the flow cross-section which is practically determined by the lower end 15' of the intermediate compartment or space 15. This widening or widened portion, i.e. the last widened portion of the flow cross-section arranged between two throttle locations functions as an additional sound dampener, so that ambient noises, as already briefly mentioned, are not capable of exciting the glass pane 17 into vibration or even penetrating through the throughpassage opening 24 directly into the room or area 23.

Above the window opening 18, however below the throughpassage opening 24 the inner wall 13 possesses a bracket-like or cantilever-like extension 36 which can serve different purposes. This extension 36, for instance, covers the throughpassage opening 24, so that such is not visible from the room or area 23. Moreover, this extension 36 functions as an attachment surface for lighting fixtures 37 and, possible, also as support means for a merely schematically indicated false ceiling 38 which is suspended in spaced relationship from the underside of the floor 10 and essentially in parallelism therewith. Since the exhaust air ejected out of the room or space 23 can only escape through the throughpassage or throughflow opening 24 it automatically wipingly contacts the lamps 37' of the lamp or lighting fixture 37, and which lamps when turned-on produce waste heat. Consequently, this exhaust air also withdraws the waste heat produced by the lamps or lighting elements 37' while simultaneously cooling the same. It will be readily appreciated that the flow cross-section of the throughpassage or throughflow opening 24, which in any event is greater than that of the exhaust or blow-off opening 25, can be adjusted with the aid of simple means, so that the pressure gradient prevailing in the intermediate compartment 15 can be accommodated to the excess pressure or overpressure prevailing in the room or space 23 and brought about by the ventilation or air conditioning installation. Care must only be taken to insure that the pressure gradient in the intermediate compartment 15, which results in the downward flow of the exhaust air, remains smaller than the difference between the partial pressures of the water vapor internally of the building on the one hand and in the external area on the other hand with higher inside temperatures of the building in contrast to the outside temperature.

Figure 4:
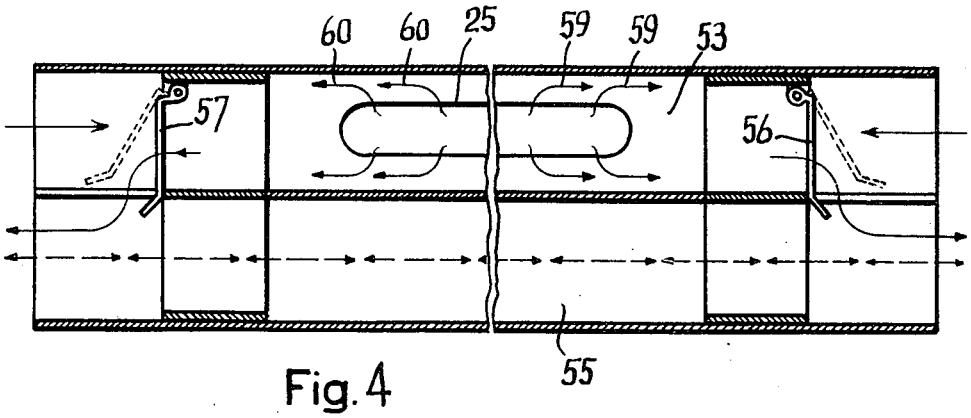
FIG. 4 is a simplified cross-sectional view taken along the line IV—IV of FIG. 3.

With the detailed showing of a modified version of facade element 12 as portrayed in FIG. 3 there will be recognized at the region of the floor 11 a portion of the inner wall 13, a portion of the outer wall 14, the lower region of the intermediately disposed intermediate compartment or space 15 and the exhaust or blow-off opening 25 which at the region of the lower end of the intermediate compartment 15 penetrates through the outer wall 14. At the region of the exhaust opening 25 there is arranged between the inner wall 13 and the outer wall 14 an essentially Z-shaped box profile or structural member 40, the lower leg 41 of which simultaneously serves as a spacer element between the inner wall 13 and the outer wall 14 and as the partition wall between the intermediate compartment 15 located above the floor 11 and the lower situated intermediate compartment. The intermediate leg 40*a* of the substantially Z-shaped box profile member 40 is constructed as a double-wall structure. In particular, this intermediate leg or leg arrangement 40*a* possesses a floor 42 and an upper closure wall 43 which together delimit a horizontally extending compartment or chamber 44. In the floor 42 there are provided one or a number of openings 45 and in the upper closure wall 43 there are likewise provided one or a number of openings 46. Within the compartment or chamber 44 there is arranged a check or nonreturn valve 33 which, in this case, consists of a light, flexible material and dimensioned and suspended in such a manner that it either can cover the openings 45 or the openings 46. For instance, the check valve 33 consists of a band 33*a* which is suspended at both of its ends and which extends with a certain throughhang along the compartment or chamber 40, i.e. in a direction perpendicular to the plane of the drawing. Furthermore, in the upper closure wall 43 there are provided two bypass-openings 47, 48, of which one can be adjusted as concerns its flow cross-section by means of a slide or slide valve 49 and an adjustment screw 50 or the like. The openings or bores 46, 47 and 48 open into a channel 51, the upper side of which is bounded by the upper leg 52 of the box profile member 40. Extending from the channel 51 is the exhaust or blow-off opening 25 which is present in the outer wall 14, this exhaust opening 25 in turn opening into a discharge channel 53. As best seen by referring to FIG. 4 the discharge or outlet channel 53 is one of two channels which is formed in a double U-shaped profile member 54 secured to the outer wall 14. The horizontally arranged U-shaped profile member 54 is open at both of its ends. Below the channel 53 there is located in the U-shaped profile member 54 a parallel throughpassage channel 55 which is open at both ends. The discharge or outlet channel 53 is somewhat shorter than the U-shaped profile member 54 and at both of its ends there are provided light, pivotable flaps or flap valves 56, 57 which extend with their free ends into the channel 55 as shown.

It is now assumed that in the outside area, i.e. externally of the outer wall 14 there initially is not present any deviation of the barometric air pressure which is attributable to movement of the air. The internal room or area 23 of the building or the like, i.e. the inside of the inner wall 13 is exposed to an overpressure. Hence, there is formed in the intermediate compartment or space 15 an exhaust air flow in the direction of the arrows 58 (FIG. 3) and this exhaust air enters the compartment or chamber 44 via the openings 45, holds the flap or valve member 33 to a certain extent in a floating condition, enters via the openings 46, 47 and 48 into the channel 51 and from that location escapes via the exhaust opening 25 into the exhaust or discharge channel 53. From that location the exhaust air flows in the sense of the arrows 59 as well as also in the sense of the arrows 60 to the ends of the channel 53, at that location raises the flaps or flap valves 56 and 57, respectively, and finally escapes through the ends of the U-shaped profile member 54 into the outside space.

Now if the outside surface of the outer wall 14 is impinged by wind, then it is initially assumed that, as a practical matter, such wind almost never impacts the outer wall 14 at right angles. Hence, there practically never arises a stationary pressure head cushion, rather a flow forms along the outer surface of the outer wall 14 in which there prevails a higher pressure in contrast to the barometric pressure. This flow, in the one or in the other direction, will flow through the U-shaped profile member 54, with the result that one of the flaps or flap valves 56, 57 is closed. Since, however, the flow in the throughpassage channel 55 is practically unhindered, the other of the flap valves 56, 57 will be opened by such flow and the exhaust air which is then present in the discharge channel 53 will be entrained by an injector action and displaced away.

On the other hand, if the outside surface of the outer wall 14 is located at the side of the building which is not impinged by wind, namely at the side facing away from the direction of the wind, then there will be formed at this side of the building a lower pressure in contrast to the barometric air pressure. This lower pressure results in the fact that the pressure gradient between the internal room or space 23 and the outside area and thus also the pressure gradient in the intermediate compartment 15 will become momentarily greater. In this case, the flow velocity of the exhaust air through the chamber or compartment 44 momentarily increases, the flap or valve member 33 is raised and renders more difficult to an increasing degree the flow through the openings 46. If the openings 46 are closed by the check valve 33 then only the bypass-openings 47 and 48 are free, the flow cross-section of which is not sufficient in order to allow the negative pressure prevailing at the outside of the building of completely coming into play in the intermediate compartment 15 in the sense that the pressure gradient adjusted in the intermediate compartment 15 will be appreciably disturbed.

The U-shaped profile member 54 with both of the channels 53, 55 and the flaps or flap valves 56, 57 — in the case of facade elements for buildings which are laterally impinged by wind forces — can also be omitted. In such case, with random pressure head at the outside of the outer wall 14 the flap valve 33 only functions as an actual check valve. Also here measures can be undertaken to insure that the openings 45 are not completely closed by the flap type-check valve 33, rather only markedly throttled. With the illustrated exemplary embodiment the openings 45 are flanked by raised portions or protuberances 61 against which there comes to bear the check valve, and there remains free a markedly throttled flow cross-section. Instead of the raised portions 61 there can be provided in the floor 42 also the bypass-openings (like in the upper closure wall 43) which flank the openings 45. The same is equally applicable for the upper closure wall 43 where, instead of the bypass-openings 47 and 48, there can be provided raised portions which flank the openings 46.

In any event the described construction of the facade element 12 at the region of its exhaust opening 25 contributes to the fact that in the intermediate compartment 15 there is automatically maintained the pressure gradient decisive for the flow of the exhaust air through the play of the check valve 33, even in the case of external pressure fluctuations, namely at a lesser value than the difference of the partial pressure of the water vapor between the inner room or space 23 and the outside area, because the overpressure generated within the building by the blower of the ventilation or air conditioning installation accommodates itself in a very short period of time to the pressure conditions in the outside area, so that the pressure gradient in the intermediate compartment or space 15 only fluctuates within very narrow limits.

It is to be remarked that namely in the case of climatized or air conditioned buildings, the parital pressure of the water vapor at temperatures between 20°C and 25°C and relative humidity values of 40 to 60 percent fluctuates between 6 to a maximum of 12 millimeters mercury column, corresponding approximately to 78 to 156 millimeters water column. Thus one is concerned with a relatively slight fluctuation range of the partial pressure of the water vapor and it is sufficient if the flow cross-section of the throughpassage or throughflow opening 24, the exhaust opening 25 and the intermediate compartment or space 15 are coordinated to one another in such a manner that the pressure gradient effective in the intermediate compartment 15 is smaller than about 2.3 millimeters mercury column or approximately 40 millimeters water column, since the partial pressure of the water vapor even at 0°C and 100 percent relative humidity of the air only is approximately equal to 4.5 millimeters mercury column or approximately 58 millimeters water column. Moreover, the partial pressures of the water vapor can be determined very easily on the basis of tables or charts for different values of the temperature and the relative humidity of the air and it would not present any difficulty for one skilled in the art to dimension the flow cross-sections of the throughpassage opening 24, the exhaust opening 25 and the intermediate compartment 15 based on the laws of flow in such a manner that the pressure gradient effective in the intermediate compartment 15 is smaller than the difference between the partial pressure of the water vapor determined for the particular case on the basis of the aforementioned tables or charts.

While there is shown and described present preferred embodiments of the invention, it is to be distinctly understood that the invention is not limited thereto, but may be otherwise variously embodied and practiced within the scope of the following claims. ACCORDINGLY,

What is claimed is:

1. A double-wall facade element for a building operating with an overpressure ventilating or air conditioning installation, said facade element comprising an inner wall and an outer wall, said inner wall and outer wall being arranged in spaced relationship from one another to form therebetween an intermediate compartment, said facade element having a first substantially horizontally extending edge and a second substantially horizontally extending edge, means defining a throughpassage opening for exhaust air at the inner wall at the region of the first horizontally extending edge of the facade element, means defining an exhaust opening for the exhaust air at the outer wall at the region of the second horizontally extending edge of the facade element, both of said openings being in flow communication with one another through the agency of the intermediate compartment disposed between the inner wall and outer wall, said throughpassage opening possessing a flow cross-section which is greater than the flow cross-section of the exhaust opening but smaller than the flow cross-section of the intermediate compartment, check valve means arranged at the region of the exhaust opening and responsive to external pressure increases in order to throttle the flow cross-section of the exhaust opening, so that there is adjusted a pressure gradient in the intermediate compartment between the throughpassage opening and the exhaust opening, said pressure gradient being smaller than the difference between the partial pressure of the water vapor internally of the building and the partial pressure of the water vapor at the outside of the building with an external temperature which is lower in contrast to the temperature internally of the building.

2. The double-wall facade element as defined in claim 1, wherein said check valve means comprises a band having an upper edge, means for hingedly mounting said band at the region of its upper edge, said band being formed of a flexible material and provided with openings.

3. The double-wall facade element as defined in claim 2, wherein the check valve means is arranged inwardly offset within the outer wall.

4. The double-wall facade element as defined in claim 1, further including sound-absorbing means arranged within the intermediate compartment directly forwardly of the exhaust opening.

5. The double-wall facade element as defined in claim 4, wherein the sound-absorbing means is provided with an expansion compartment and structure which extends through the intermediate compartment transversely with respect to the flow direction of the exhaust air.

6. The double-wall facade element as defined in claim 5, wherein said structure and said expansion compartment are respectively sequentially arranged forwardly of the exhaust opening with respect to the direction of flow of the exhaust air in the intermediate compartment.

7. The double-wall facade element as defined in claim 1, wherein said throughpassage opening and said exhaust opening each possess a substantially slot-shaped configuration and together with the intermediate compartment extend practically over the entire horizontal length of the facade element.

8. The double-wall facade element as defined in claim 1, wherein at least one further throughpassage opening is arranged following the check valve means, said further throughpassage opening being at least partially covered by the check valve means upon the occurrence of negative pressures externally of the building.

9. The double-wall facade element as defined in claim 8, further including a substantially elongate, horizontally extending compartment, said check valve means comprising a band-like element arranged in said elongate compartment, said elongate compartment having a floor portion and a ceiling portion, said band-like element being suspended within said elongate compartment between said floor portion and said ceiling portion for movement in a direction extending transversely with respect to the plane of said band-like element, said further throughpassage opening being provided at said ceiling portion, and said floor portion being provided with at least one inlet opening communicating with the intermediate compartment.

10. The double-wall facade element as defined in claim 9, further including means defining bypass-openings arranged externally of the effective region of the check valve means, said bypass-openings possessing a smaller flow cross-section than the flow cross-section of the further throughpassage opening and the inlet opening, said bypass-openings being operatively associated with at least any one of said further throughpassage opening, said inlet opening, or both.

11. The double-wall facade element as defined in claim 9, further including means operatively associated with the further throughpassage opening for preventing a complete closing of said throughpassage opening by the check valve means.

12. The double-wall facade element as defined in claim 9, further including means operatively associated with the inlet opening for preventing a complete closing of said inlet opening by said check valve means.

13. The double-wall facade element as defined in claim 8, further including channel means from which emanates the exhaust opening leading to the external area of the building, said further throughpassage opening into said channel means.

14. The double-wall facade element as defined in claim 9, wherein said inlet opening is arranged beneath said further throughpassage opening.

15. The double-wall facade element as defined in claim 9, wherein said further throughpassage opening and said inlet opening each possess a substantially slot-shaped configuration.

16. The double-wall facade element as defined in claim 9, wherein said further throughpassage opening and said inlet opening each comprise a series of bores.

17. The double-wall facade element as defined in claim 13, further including a substantially horizontal lengthwise extending discharge channel having a lengthwise extending side, the exhaust opening opening into the lengthwise extending side of said horizontal, lengthwise extending discharge channel, said discharge channel having opposed ends, and hingedly mounted valve means for closing both ends of the discharge channel.

18. The double-wall facade element as defined in claim 17, further including throughpassage channel means having opposite ends which are open, said throughpassage channel means being arranged in substantial parallelism with said discharge channel, said throughpassage channel means providing a flow path for the exhaust air, said hingedly mounted valve means having free ends extending into said flow path of said throughpassage channel means.

* * * * *

UNITED STATES PATENT OFFICE
CERTIFICATE OF CORRECTION

PATENT NO. : 3,982,475

DATED : September 28, 1976

INVENTOR(S) : Ernst Wild

It is certified that error appears in the above-identified patent and that said Letters Patent are hereby corrected as shown below:

Column 1, line 37, after "particu" insert -- - --.

Column 1, line 48, read "250°C" as -- 25°C --.

Column 2, line 56, read "tht" as -- that --.

Column 2, line 61, read "blowoff" as -- blow-off --.

Column 3, line 3, read "of vacuum" as -- or vacuum --.

Column 3, line 68, read "perpendiuclar" as -- perpendicular --.

Column 10, lines 24-25, read "throughpassage opening into" as -- throughpassage opening opening into --.

Signed and Sealed this

Twenty-second Day of February 1977

[SEAL]

*Attest:*

RUTH C. MASON
*Attesting Officer*

C. MARSHALL DANN
*Commissioner of Patents and Trademarks*